US011555372B1

(12) United States Patent
Al-Mousa

(10) Patent No.: US 11,555,372 B1
(45) Date of Patent: Jan. 17, 2023

(54) SMART BLOW OFF PREVENTER SHEAR RAM SYSTEM AND METHODS

(71) Applicant: Saudi Arabian Oil Company, Dhahran (SA)

(72) Inventor: Ahmed Abdulaziz Al-Mousa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/448,405

(22) Filed: Sep. 22, 2021

(51) Int. Cl.
*E21B 33/06* (2006.01)
*E21B 47/06* (2012.01)

(52) U.S. Cl.
CPC ..... *E21B 33/063* (2013.01); *E21B 47/06* (2013.01)

(58) Field of Classification Search
CPC ..... E21B 33/06; E21B 33/062; E21B 33/063; E21B 33/064
See application file for complete search history.

(56) References Cited

U.S. PATENT DOCUMENTS

| | | | |
|---|---|---|---|
| 8,149,133 | B2 | 4/2012 | Milne |
| 8,657,253 | B2 | 2/2014 | Judge et al. |
| 8,781,743 | B2 | 7/2014 | McKay et al. |
| 8,881,829 | B2 | 11/2014 | Redden et al. |
| 9,273,663 | B2 * | 3/2016 | Wright ..... F03B 13/00 |
| 9,347,289 | B2 | 5/2016 | Judge et al. |
| 9,759,033 | B2 | 9/2017 | Meraz et al. |
| 9,863,206 | B2 | 1/2018 | Biester et al. |
| 9,976,375 | B2 | 5/2018 | Kotrla et al. |
| 10,048,673 | B2 | 8/2018 | Holmes et al. |
| 10,590,726 | B1 * | 3/2020 | McAuley ..... E21B 33/038 |
| 10,787,877 | B2 | 9/2020 | Pedersen et al. |
| 10,900,317 | B2 * | 1/2021 | Daley ..... E21B 47/12 |

(Continued)

FOREIGN PATENT DOCUMENTS

| | | | |
|---|---|---|---|
| AU | 2015201953 | A | 5/2015 |
| CA | 2927910 | A1 | 4/2016 |

OTHER PUBLICATIONS

BOP Technologies—BOP Fail-safe; web page <https://www.oedigital.com/news/450689-bop-technologies-launches-fail-safe-design>; Dec. 10, 2015.

(Continued)

*Primary Examiner* — Kenneth L Thompson
(74) *Attorney, Agent, or Firm* — Leason Ellis LLP

(57) ABSTRACT

A system and method for shutting in a wellbore in the event that primary blow-out preventer (BOP) system fails. The system comprises a smart-BOP shear ram system that operates independently and autonomously from the primary BOP system and that includes a pneumatically actuated shear ram installed on top of the primary BOP preventers. A dedicated control system and pneumatic pump are encased inside one or more explosion proof boxes. The control system detects primary BOP failure using sensors located above and below the primary BOP shear ram and actuates the smart-BOP shear ram accordingly. The control system is configured such that, activation of the primary BOP stack automatically activates the smart-BOP shear ram system and the control unit assumes autonomous control over operation of the smart-BOP shear ram until the control unit confirms that a complete seal has been made against the wellbore fluids.

16 Claims, 6 Drawing Sheets

(56) References Cited

U.S. PATENT DOCUMENTS

| | | | | |
|---|---|---|---|---|
| 11,060,372 | B2 | 7/2021 | Bourgeau et al. | |
| 2012/0001100 | A1 | 1/2012 | Hubbell, Jr. | |
| 2012/0217019 | A1 | 8/2012 | Zediker et al. | |
| 2013/0153241 | A1* | 6/2013 | Mallinson | E21B 33/0355 166/363 |
| 2014/0231075 | A1* | 8/2014 | Springett | E21B 33/06 166/250.01 |
| 2017/0218717 | A1 | 8/2017 | Brinsden | |
| 2019/0078426 | A1* | 3/2019 | Zheng | E21B 21/08 |
| 2020/0378208 | A1 | 12/2020 | Jamieson | |
| 2022/0056778 | A1* | 2/2022 | Olson | F04B 23/04 |
| 2022/0282587 | A1* | 9/2022 | Ducamin | E21B 21/08 |

OTHER PUBLICATIONS

Towards Automated Condition Monitoring of Blowout Preventer Wellbore Packers; Annual Conference of the Prognostics and Health Management Society; Schlumberger; 2018.

* cited by examiner

SMART BLOW OFF PREVENTER SHEAR RAM SYSTEM AND METHODS

FIELD OF THE DISCLOSURE

This disclosure relates to well shut-in system tools and more particularly, to blow-out preventer (BOP) apparatuses, systems, and methods for sealing boreholes in an emergency condition.

BACKGROUND OF THE DISCLOSURE

In some well control incidents, such as those associated with well blow outs, fires, or otherwise, rig personnel follow operating procedures that can involve shutting the well in an effort to prevent hydrocarbon fluids from escaping the well bore or casing. For example, a shut-in procedure during a drilling operation can include stopping the drilling system and actuating one or more blow-out preventers (BOP) of a BOP stack. A conventional BOP stack can include a plurality of preventers of various types including, for example, annular, shear ram, blind ram or pipe ram preventers that are activated from a control panel provided at the drilling rig. Once the well has been safely shut-in, pressures and volumes can be monitored to determine if the well has "kicked," whereby further well control measures are often required. In some situations, however, the primary BOP system can fail to fully seal the well and the failure of shear rams is a major reason for blowouts in the oil & gas industry.

It is with respect to these and other considerations that the disclosure herein is presented.

SUMMARY OF THE DISCLOSURE

According to an aspect of the present disclosure, there is provided a well-shut in system. The well shut-in system comprises a smart blow-out preventer (BOP) system for use with a primary BOP system, which includes one or more preventers configured to be manually activated from a remotely located control panel to shut-in a wellbore.

The smart-BOP system is configured to automatically and autonomously shut in the wellbore in the event of failure of the primary BOP system. In particular, the smart-BOP system comprises a shear ram configured to be mounted on top of the one or more preventers of the primary BOP system and configured to shut-in the wellbore. The shear ram includes an outer housing defining a central cavity for receiving a wellbore tubular pipe therethrough and two opposing cutting blades that can be pneumatically transitioned from an open state to a closed state for cutting the pipe.

The smart-BOP system also includes a plurality of sensor units provided above and below the one or more preventers of the primary BOP system and within a pipe annulus of the one or more preventers. The sensor units are configured to wirelessly transmit respective measurements to a local control unit and the plurality of sensor units include a plurality of fluid movement sensors, a plurality of pressure sensors, and a plurality of temperature sensors.

The smart-BOP system further comprises a shear ram control system configured to operate separately and independently from the primary BOP system. In particular, the shear ram control system includes a pneumatic power unit in fluid communication with the shear ram and configured to actuate the shear ram by providing pneumatic fluid to the shear ram through the pneumatic control lines. The pneumatic power unit is also in fluid communication with a compressor unit and is communicatively coupled to the local control unit through a hard-wired connection. Additionally, the pneumatic power unit is configured to contain a compressed air charge sufficient to close the cutting blades of the shear ram.

The smart-BOP system further comprises the compressor unit, which is configured to supply the pneumatic power unit with compressed air, and a backup battery, which is configured to store enough electrical energy for operating the shear ram control system in the absence of an external power supply.

The smart-BOP system further comprises the local control unit, which is in wireless communication with the plurality of sensors and which includes a processor and a non-transitory computer readable storage medium having a ram controller algorithm stored thereon. More specifically, the ram controller algorithm is executable by the processor and configures the processor to activate the plurality of sensor units in response to receipt of a signal from the control panel of the primary BOP system indicating that the primary BOP system has been triggered to close the one or more preventers to shut-in the wellbore. Additionally, the plurality of sensors are configured to capture the respective measurements from within the pipe annulus during a period of time before and after the closing of the one or more preventers. The processor is further configured to compare the respective measurements of the plurality of sensors captured before and after closing of the one or more preventers to detect a failure of the one or more preventers to shut-in the wellbore. The processor is further configured to trigger, based on detecting the failure, the pneumatic power unit to actuate the shear ram thereby closing the cutting blades to shear the tubular pipe and shut-in the wellbore. Furthermore the smart-BOP system comprises one or more explosion-proof housings within which the shear ram control system is housed.

According to a further aspect, a well shut-in method is disclosed. The well shut-in method comprises providing a smart blow-out preventer (BOP) system. The smart-BOP system is provided on top of a primary BOP system of a wellbore that includes one or more preventers configured to be manually activated from a remotely located control panel to shut-in the wellbore.

The smart-BOP system is configured for automatically and autonomously shutting in the wellbore in the event of failure of the primary BOP system. The smart-BOP system includes a shear ram configured to be mounted on top of the one or more preventers of the primary BOP system and configured to shut-in the wellbore. More specifically, the shear ram includes an outer housing defining a central cavity for receiving a wellbore tubular pipe therethrough and two opposing cutting blades configured to be pneumatically transitioned from an open state to a closed state for cutting the pipe. Additionally, the smart-BOP system includes a plurality of sensor units provided above and below the one or more preventers of the primary bop system and within a pipe annulus of the one or more preventers. The plurality of sensor units are configured to wirelessly transmit respective measurements to a local control unit and include a plurality of fluid movement sensors, a plurality of pressure sensors, and a plurality of temperature sensors.

The smart-BOP system further comprises one or more explosion-proof housings and a shear ram control system contained within the one or more explosion-proof housings. The shear ram control system is configured to operate separately and independently from the primary BOP system. The shear ram control system includes a pneumatic power unit in fluid communication with the shear ram and configured to actuate the shear ram by providing pneumatic fluid to the shear ram through pneumatic control lines. The pneumatic power unit is also in fluid communication with a compressor unit and is communicatively coupled to the local control unit through a hard-wired connection. Furthermore, the pneumatic power unit is configured to contain a compressed air charge sufficient to close the cutting blades of the shear ram.

The smart-BOP system further comprises the compressor unit, which is configured to supply the pneumatic power unit with compressed air, and a backup battery, which is configured to store enough electrical energy for operating the shear ram control system in the absence of an external power supply. The smart-BOP system further comprises the local control unit, which includes a processor and a non-transitory computer readable storage medium having a ram controller algorithm stored thereon. The local control unit is in wireless communication with the plurality of sensors and the processor is configured by executing the ram controller algorithm.

The method further comprises the step of receiving, by the local control unit, a signal from the control panel of the primary BOP system indicating that the primary BOP system has been triggered to close the one or more preventers to shut-in the wellbore. Additionally, the method includes activating the plurality of sensor units, by the local control unit in response to receipt of the signal from the control panel. The method also includes capturing, by the plurality of sensor units, the respective measurements from within the pipe annulus during a period of time before and after the closing of the one or more preventers.

Moreover, the method includes comparing, by the local control unit, the respective measurements of the plurality of sensors before closing of the one or more preventers to the respective measurements captured after closing of the one or more preventers. Furthermore, the method includes detecting, by the local control unit based on the comparison, a failure of the one or more preventers to shut-in the wellbore and, based on detecting the failure, triggering the pneumatic power unit to actuate the shear ram and thereby closing the cutting blades to shear the tubular pipe and shut-in the wellbore.

These and other aspects, features, and advantages can be appreciated from the accompanying description of certain embodiments of the disclosure and the accompanying drawing figures and claims.

BRIEF DESCRIPTION OF THE DRAWINGS

The foregoing and other features of the arrangements of the present disclosure will be more readily apparent from the following detailed description and drawings of an illustrative embodiment of an invention encompassed by the disclosure.

DESCRIPTION OF CERTAIN EMBODIMENTS OF THE DISCLOSURE

By way of overview and introduction, embodiments of the systems and methods disclosed herein generally concern aspects of a well shut-in or "blow out preventer" (BOP) system. In particular, an autonomously operating "smart-BOP" shear ram and related control systems are provided to automatically activate shear rams, as a fail-safe, in the event that the primary BOP stack fails to effectively shut-in a wellbore.

Failure of preventers in the primary BOP stack is a major reason for blowouts in the oil & gas industry. Embodiments of the systems and methods disclosed herein provide a solution in those cases where primary shear rams fail to function effectively and conditions, such as wellbore fluids influx at the surface, do not allow human/manual intervention to shut the well in using the primary BOP stack. The smart-BOP shear ram system and methods provide robust back-up, thus, eliminating the risk of blowouts in drilling and workover operations.

As further described herein, the smart-BOP shear ram system includes one or more shear rams that can be installed on top of the primary BOP stack so as to avoid having to reconfigure an existing BOP stack that is operated in a conventional manner. The smart-BOP shear rams are pneumatically operated by a dedicated control system and pneumatic pump that are encased inside one or more explosion proof boxes near the BOP stack. The control system comprises a processor configured to detect primary shear ram failure from sensors located above and below one or more preventers of the primary BOP stack, and send commands to actuate the smart-BOP shear rams accordingly. More specifically, the control system is configured such that, once the primary BOP stack is activated by the driller from the BOP control panel, the smart-BOP shear ram system is automatically activated. Further, the control unit will assume control over operation of the smart-BOP shear ram and is configured to operate autonomously until a complete seal is made against the wellbore fluids. Wireless sensors, which are located above and below the shear ram preventer of the primary BOP stack, are configured to provide data to the control system enabling the control unit to monitor and confirm effectiveness of conventional shear ram closure against the pipe in-cases of uncontrollable "kicks." The control system is also configured such that, for those scenarios where the primary BOP stack shear rams have closed and achieved a complete seal of the wellbore, then the smart-BOP shear rams will not be actuated.

Figure 1:
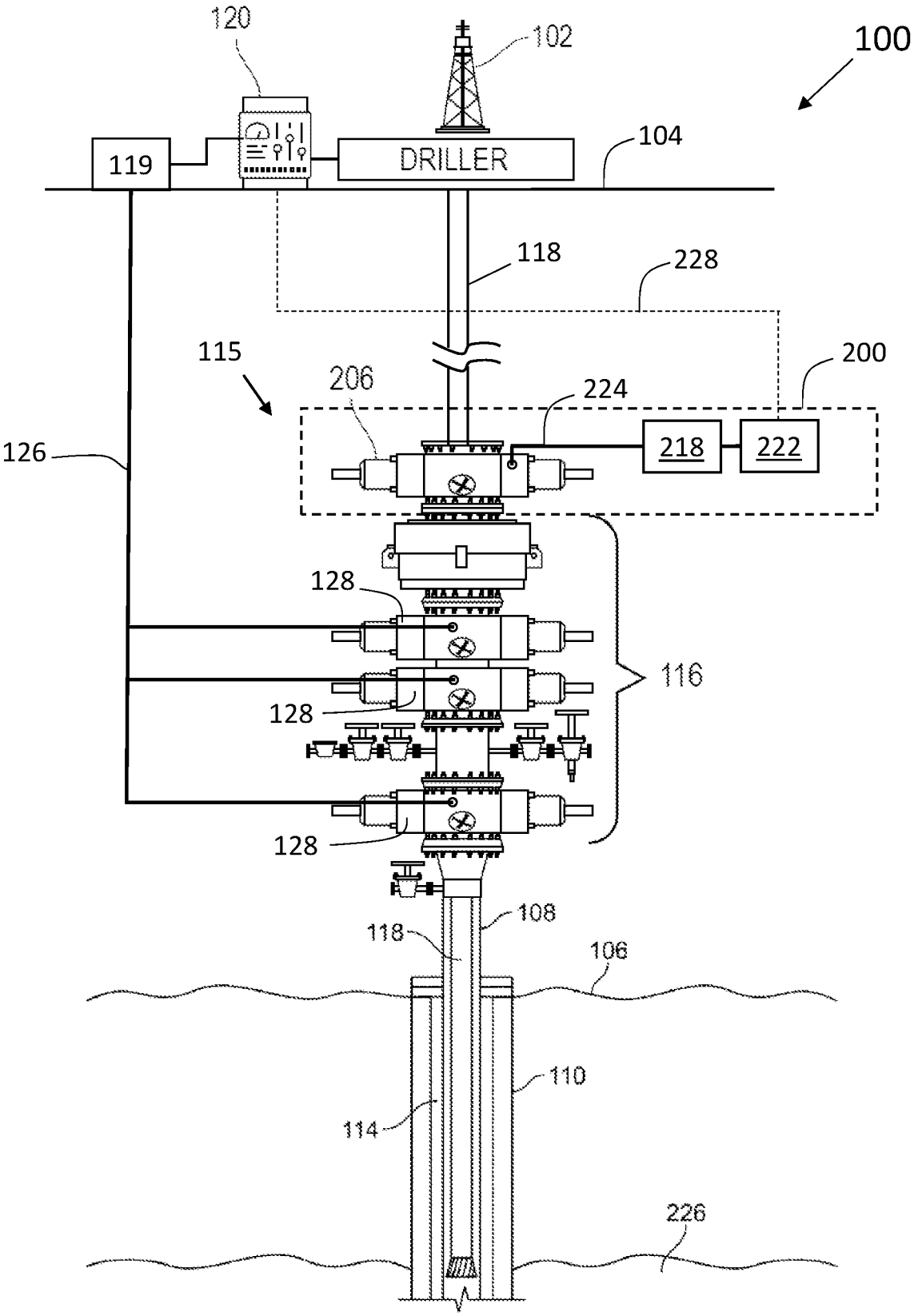
FIG. 1 illustrates a schematic view of an example well system that includes a drilling rig and a well shut-in system comprising an automatically activated smart-BOP shear ram according to an embodiment.

FIG. 1 illustrates a schematic view of an example well system 100 that includes a well shut-in system comprising a smart-BOP shear ram system in accordance with an embodiment. The well system 100 can be attached to a workover or drilling rig 102 positioned on or above the earth's surface 106 (for example, a ground surface or a sub-sea surface) and extends over and around a wellbore 108 that penetrates a subterranean formation for the purpose of recovering hydrocarbons. The wellbore 108 can be drilled into the subterranean formation using any suitable drilling technique. For example, and without limitation, the illustrated wellbore 108 extends substantially vertically away from the earth's surface 106. The wellbore 108 can be any one or more of a variety of suitable types of wellbores for drilling and completing one or more production zones. Further the wellbore 108 can be completely cased with a casing 110, partially cased, or an open hole (e.g., uncased) or variations thereof.

A wellbore tubular string 118, for instance a drill pipe (DP) string, can be lowered into the subterranean formation for a variety of purposes (for example, drilling, intervening, injecting or producing fluids from the wellbore, workover or treatment procedures, or otherwise) throughout the life of the wellbore 108. In this illustrated example, the workover or drilling rig 102 (not shown to scale) can comprise a structure from which the tubular drill pipe (DP) string extends downward from into the wellbore 108. As would be understood, the drilling rig can comprise a motor driven drilling system and other associated equipment for extending the drill pipe string 118 into the wellbore 108 to a selected depth. While the operating environment depicted in FIG. 1 refers to a drilling rig for conveying the drill pipe string 118 within a land-based wellbore 108, the exemplary systems and methods disclosed herein can be utilized in alternative implementations and operational environments, such as within an offshore wellbore operational environment.

As illustrated, the drill pipe 118 extends through a blowout preventer (BOP) stack 115 comprising a primary BOP stack 116 that includes one or more (as shown, three) preventers 128 that can be configured and operated in a conventional manner. For example, the BOP stack 116 can include one or more shear ram-type preventers 128. The particular configuration of the primary BOP stack 116 is not intended to be limiting and the primary BOP stack can comprise any suitable combination of BOP devices, whether presently known or unknown. The BOP stack 115 can also include various adapters, valves, and piping outlets to permit the circulation of wellbore fluids under pressure in the event of a well control incident.

As illustrated, the preventers 128 of the BOP stack 116 are actuated by, for example, hydraulic fluid that is circulated through control lines 126 from a hydraulic power unit (HPU) 119. As would be understood by those in the art, the HPU 119 is operable to circulate a controlled-pressure hydraulic fluid to one or more of the preventers 128 to actuate the one or more preventers 128 to shut-in the wellbore 108. As illustrated, there can be one or more control panels for the HPU 119. One control panel 120 can be located on the rig floor 104 or in close proximity for easy operation by rig hands during workover, completion, drilling, or other operations. The control panel 120, for example, can be used to control the HPU 119 and in turn actuate one or more of the preventers 128.

As shown in FIG. 1 the BOP stack 115 further comprises the smart-BOP shear ram system 200 which includes a shear ram 206 and which is provided as a fail-safe in the event of a failure of the primary BOP stack 116. Components of the smart-BOP shear ram system 200 are shown in FIG. 2 and further described herein with continued reference to FIG. 1.

Figure 2:
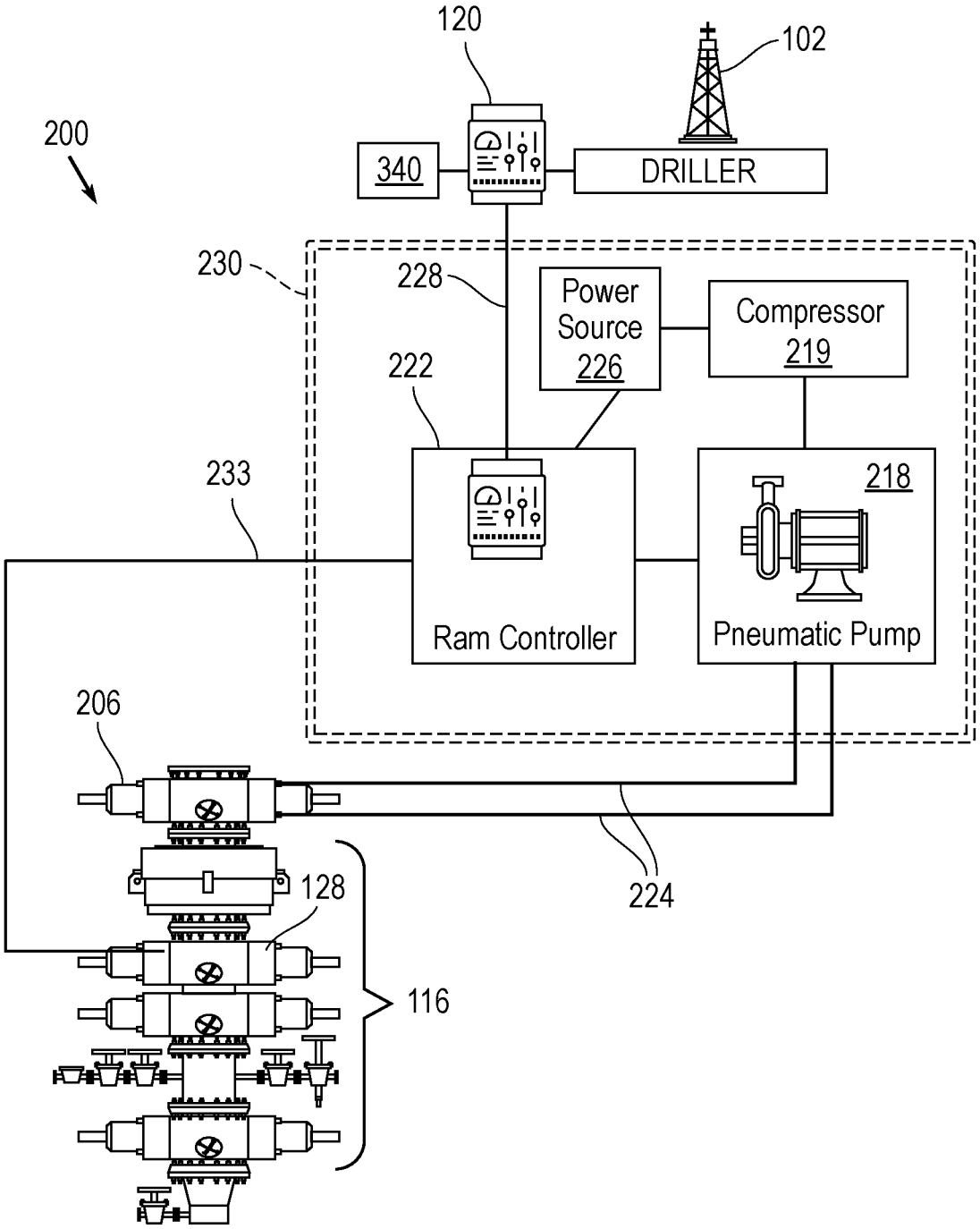
FIG. 2 illustrates a schematic view of an example implementation of a smart-BOP shear ram system according to an embodiment.

FIG. 2 illustrates a schematic view of an example implementation of the smart-BOP shear ram system 200 of the well system 100. The smart-BOP shear ram system 200 comprises one or more preventers 206 (in this case, one). In this exemplary implementation, the preventer can be a shear ram preventer that, when actuated, is configured to shear the tubing string 118 and seal the well 108 against loss of hydrocarbon fluid. However, in some embodiments the one or more preventers can comprise other types of preventers that are suitable for the application.

As illustrated, the shear ram 206 can be mounted on top of the primary BOP stack 116, to avoid configuration changes in the primary BOP stack 116 design. The smart-BOP shear ram system 200 can be added to the BOP stack 116 after fabrication, after installation, or otherwise, specifically to retro-fit a conventional BOP stack and implement the fail-safe mechanisms of the smart-BOP shear ram system 200.

As illustrated, the shear ram 206 is actuated by, for example, pneumatic fluid (e.g., compressed air) that is circulated through control lines 224 from a pneumatic power unit (PPU) 218. As would be understood by those in the art, the PPU 218 is operable to circulate a controlled-pressure pneumatic fluid (i.e., compressed air) to the shear ram 206 to actuate the shear ram to shut-in the wellbore 108. Additionally, a compressor 219 is in fluid communication with the PPU and configured to supply the compressed air to the PPU 218. In alternative configurations, the PPU 218 can be exchanged for an HPU for hydraulically actuating the shear ram 206.

The PPU 218 operates to actuate the shear ram 206 to shut in the wellbore 108 under the control of a local control unit 222 (LCU, also referred to as "Ram Controller"). As illustrated in this example, control lines 224 (for example, pneumatic lines) from the PPU 218 are fluidly coupled to the preventer 206. In this case the PPU 218 is a unit dedicated to the preventer 206 and is additional to the HPU 119 for actuating the primary BOP stack 116 in a conventional manner.

In the illustrated example, the LCU 222 is communicatively coupled to the PPU 218 (for example, hard wired or otherwise) and can be communicatively coupled to the control panel 120 using a suitable wired or wireless connection 228. The communication connection 228 can enable one-way communication (for example, from the control panel 120 to the LCU 222, or vice versa) or can be a two-way communication connection between the units 120 and 222. As described more fully herein, the control panel 120 can be activated to actuate the primary BOP stack 116 which in turn signals the LCU 222 to monitor the operational status of the primary BOP stack 116 and, as necessary, actuate the shear ram 206.

The smart-BOP shear ram system 200 can further comprise a backup power source 226, such as a battery. The compressor 219 along with the PPU 218 are configured to contain sufficient energy (i.e., the PPU is charged with enough compressed air) to close the shear ram 206 completely. This setup is configured to operate even if a local or external power source is not available. However, when online, the compressor 219 can be configured to operate using an electric power connection to the drill rig 102 to keep the PPU 218 charged, provided the connection is available. Additionally, the LCU 222 is configured to operate using power from the power source 226, or another backup internal power source (not shown), which are also configured to contain sufficient energy to operate the LCU 222 in the event that an external power source is not available.

The LCU 222, PPU 218 and associated components such as the power source 226 and compressor 219, provide a dedicated system for controlling the shear ram 206 independent of the systems for operating the primary BOP stack 116. In the illustrated embodiment, the LCU, PPU, compressor, power supply and related components can be encased inside one or more explosion proof housings 230, so as to avoid damage of the smart-BOP shear ram control systems in the event of a blow-out, "kicks" and other such events. The encased control devices for the smart-BOP shear ram system 200, can be located relatively close to the wellbore 108, for example, within feet or yards, or at greater distances, for example, 10s or 100s of yards.

Figure 3A:
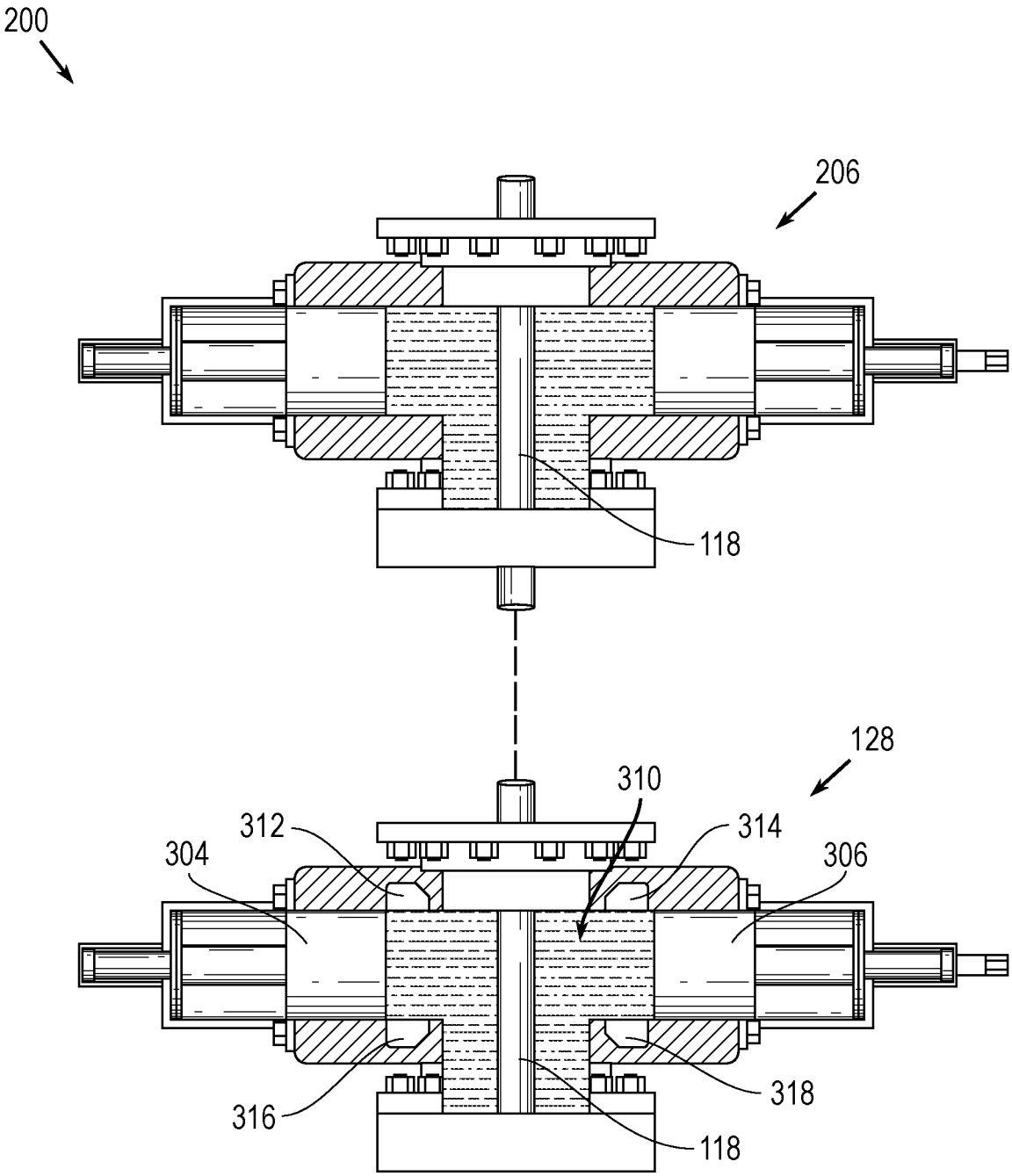
FIG. 3A illustrates a cut-away front view schematic of an example implementation of a smart-BOP shear ram in an open state according to an embodiment.
Figure 3B:
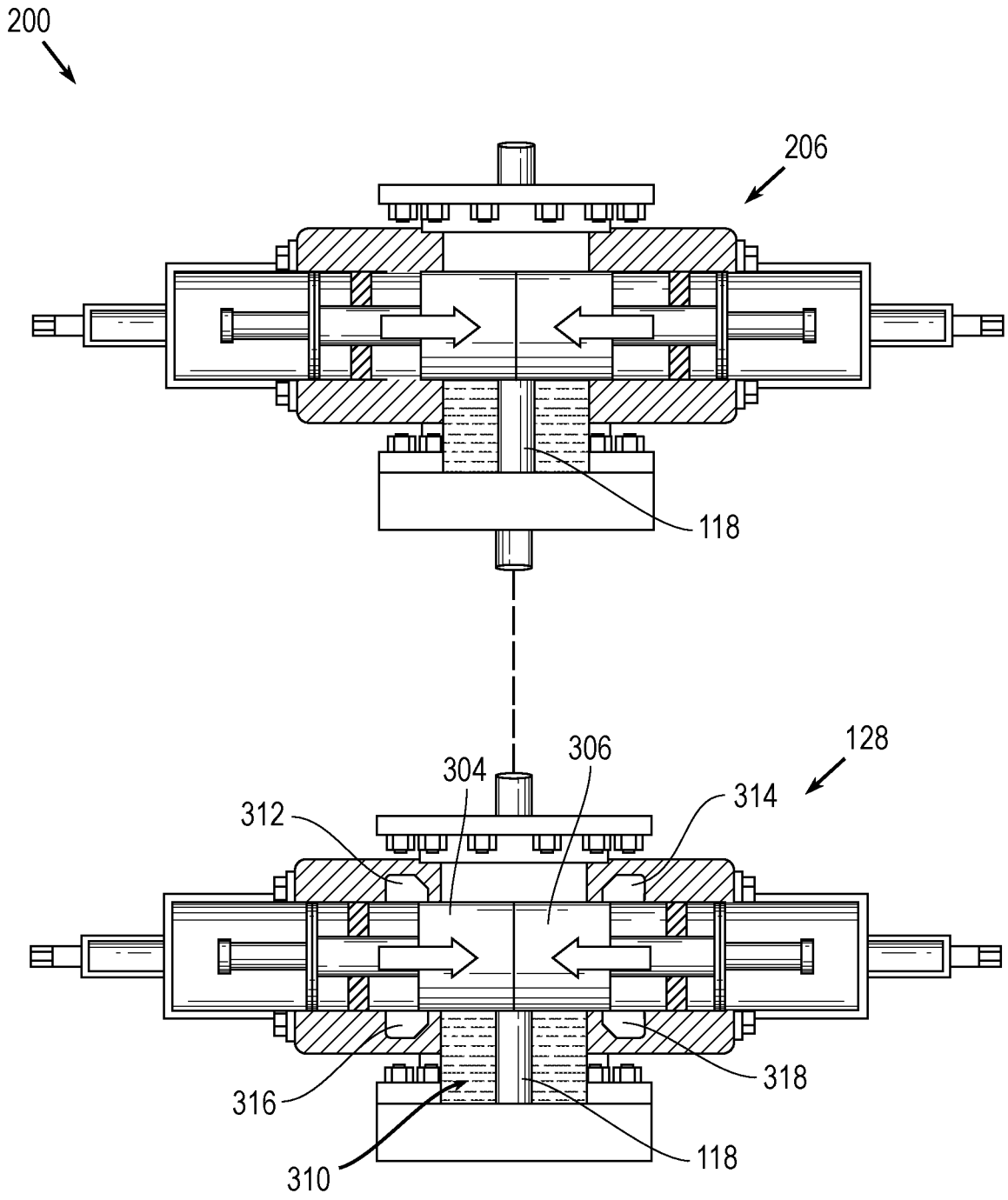
FIG. 3B illustrates a cut-away front view schematic of an example implementation of a smart-BOP shear ram of FIG. 3A in a closed state according to an embodiment.

The exemplary configuration of the smart-BOP shear ram system 200 comprising shear ram 206 and associated sensor systems mounted in relation to a conventional shear ram preventer 128 of the primary BOP stack 116 is further described in connection with FIGS. 3A-3B and with continued reference to FIGS. 1-2. FIG. 3A illustrates a cut-away front view schematic of the smart-BOP shear ram 206 and the shear ram preventer 128 according to an embodiment. In the exemplary embodiment shown, the shear ram 128 has been retrofitted to include sensor devices used by the LCU 222 to selectively actuate the shear ram 206 in the event that the shear ram 128 fails to properly seal the borehole. FIG. 3A illustrates the shear rams 206 and 128 in an unactuated (i.e., open) state. FIG. 3B illustrates a cut-away front view schematic the smart-BOP shear ram 206 and the shear ram preventer 128 in an actuated (i.e., "closed") state.

As shown, the smart-BOP shear ram system 200 includes sensors placed above and below the cutting blades of the shear ram 128 and that are configured to provide measurement data to the LCU 222 that enables the LCU 222 to confirm effectiveness of primary BOP shear ram 128 closure against the pipe, say, in-case of uncontrollable kicks. For instance, the shear ram 128 can contain sensors provided above and below the opposing shear-ram cutting blades 304 (left cutting blade) and 306 (right cutting blade).

In an embodiment the smart-BOP shear ram 200 system comprises six (6) sets of sensors provided within the drill pipe annulus, with three (3) sets located above and three (3) sets below the shear ram blades 304 and 306. The sets of sensors provided above, or below, the blades can be evenly spaced apart circumferentially. For instance, in an embodiment the sensors are spaced apart 120 degrees about the central axis of the drill pipe. The sensors provided above and below can also be arranged such that they are vertically aligned and spaced apart vertically. For instance, the upper and lower sensors can be spaced apart two inches (2") in the vertical direction. Accordingly, the sets of data recorded by the sensors provided above the conventional shear rams blades can be compared with the data sets from the sensors provided below the shear rams blades, in order to detect any differences and evaluate the closure performance of conventional shear rams. In some embodiments, the sensor units can be provided at respective radial distances from the drill pipe in the radial direction, wherein the respective distances can be the same or different depending on the application requirements.

As illustrated in the embodiment of FIGS. 3A and 3B, a first sensor unit 312 can be provided within the open central cavity 310 (i.e., "drill pipe annulus") at a position above the blades and to the left (as shown) of the drill pipe 118, which extends vertically through the central cavity. A second sensor unit 314 can be provided within the drill pipe annulus 310 at a position above the blades and to the right (as shown) of the drill pipe 118. A third sensor unit 316 can be provided within the drill pipe annulus 310 at a position below the blades and to the left of the drill pipe 118. A fourth sensor unit 318 can be provided within the drill pipe annulus 310 at a position above the blades and to the right of the drill pipe 118. Although obscured and thus not shown in FIGS. 3A and 3B, fifth and sixth sensor units can be provided within the drill pipe annulus 310 and spaced apart vertically and circumferentially relative to sensor units 312, 314, 316 and 318, as described above. For clarity, if the exemplary sensor configuration of FIGS. 3A-3B were viewed from above, second sensor unit 314 and fourth sensor unit 318 are positioned at the four o'clock circumferential position (120 degrees), first sensor unit 312 and third sensor unit 316 are provided at the seven o'clock position (240 degrees), and the fifth and sixth sensor units would be located at the twelve o'clock position (0 and 360 degree origin).

In an embodiment, the sensor units can comprise one or more types of sensors that are in wired or wireless communication with the LCU 222 over a communication connection 233 (shown in FIG. 2). Preferably, the sensor units are configured to communicate wirelessly with the LCU, so as to avoid any wired connections that can be more susceptible to breakage in the event of a blow-out.

In an embodiment, the sensor units comprise fluid movement sensors provided within the drill pipe annulus of shear ram 128 and spaced apart vertically relative to the shear ram blades 304, 306 and distributed circumferentially about the drill pipe 118 as explained above. The fluid movement sensors detect fluid flow within the drill pipe annulus 310 between the ram blades 304, 306 and the drill pipe 118, as well as through the drill pipe 118 which is across the rams.

The fluid movement sensors can be acoustic sensors configured to capture and send noise (i.e., sound) log data to the LCU 222 for analysis. In particular, the LCU is configured to compare the noise log data from before and after the closure of the primary BOP stack shear rams to evaluate the seal against wellbore fluids. The noise log readings are qualitative and, for instance, the LCU 222 can be configured to analyze the noise log readings from before and after the closure of the shear rams to determine whether any difference in the logged sound data indicates the presence or absence of fluid flow after closure. If the preventers 128 of the BOP stack 116 manage to cut and seal the well, after closure there will be no flow above the blades of shear ram 128 of the BOP stack 116. Fluid movement sensors configured to detect movement acoustically can be preferable as they can detect the sound of fluid movement within the drill pipe 118 without being placed in or on the drill pipe. By comparison, conventional flow meters having impellers would need to be placed within respective passageways (e.g., the drill pipe or drill pipe annulus) to detect fluid flow therethrough.

The electric power requirement of the sensor units is relatively low and power can be provided from on-board batteries (not shown) or a connected battery (not shown) that can be housed inside the explosive proof housing 230. In some embodiments, the battery can be charged continuously through the drill rig's electric system and, in-case of power failure due to a blow-out, the battery 226 can be configured to provide the electric source for period of time sufficient to detect any leakage and operate the smart-BOP shear ram 206 accordingly.

Sensor units (e.g., 312, 314, 316 and 318) can also comprise pressure and temperature sensors that are configured to measure temperature and pressure within the drill pipe annulus 310 and transmit such readings to the LCU 222. Leakage of wellbore fluids through the primary BOP stack into the drill pipe annulus 310 or through the drill pipe 118 passing therethrough can result in an increase in pressure within the drill pipe annulus 310 or a change in temperature. Accordingly, the LCU 222 can be configured to compare the pressure and temperature readings measured before and after the closure of the primary BOP stack preventers 128 to detect changes in the measurements and accordingly detect leakage of wellbore fluids through the primary BOP stack 116 indicating an incomplete seal. Additionally, the respective readings of the sensor units (e.g., fluid flow, temperature and/or pressure) captured at any given time can be compared to identify any salient differences and relative changes. For instance, after closure of the shear ram blades 304 and 306, the temperature and pressure and flow readings measured from below the blades can be compared to the readings measured above the shear ram blades to determine whether any differences in the readings indicate a complete seal, leakage, and the like.

In the exemplary embodiment shown in FIGS. 3A-3B, each of the sensor units can comprise a fluid sensor, pressure sensor and temperature sensor. However, in some embodiments one or more of the sensor devices can be omitted from one or more of the sensor units, depending on application requirements. In some embodiments, other types of sensor devices can be incorporated into one or more of the sensor units. Moreover, the sensors need not be combined into sensor units comprising multiple different sensor devices, as sensors can be separately provided within or around the shear rams. Additionally, although a particular arrangement of six sensor units is described in connection with the embodiment shown in FIGS. 3A-3B, this exemplary configuration is not intended to be limiting. In some embodiments, more or fewer sensors can be utilized and the arrangement of the sensors can vary depending on application requirements.

The smart-BOP shear ram system 200 can further comprise one or more LEL sensors (340, shown in FIG. 2) which can be placed at various places about the drilling rig 102, rig floor 104 and/or BOP stack 115. For instance, the LEL sensors can be provided at different positions of the rig such as at the bell nipple, rig floor and shale shakers. As would be understood to those in the art, LEL sensors are configured to detect hazardous levels of a combustible gas or solvent vapor in air, expressed in % LEL, or Lower Explosive Limit. The LEL sensors can be configured to provide LEL readings to the LCU 222, which in turn, can be configured to monitor the LEL sensor measurements to detect leakage of combustible gasses or solvent vapors caused by leakage of wellbore fluids through the primary BOP stack 116 or other hazardous conditions.

Although the various sensors including fluid flow, temperature, pressure and LEL sensors are described as being used to detect the leakage of wellbore fluids through the primary BOP stack 116 after actuation of one or more of the preventers 128, it should be understood that such sensors can similarly be provided in relation to the smart-BOP shear ram 206 and used by the LCU 222 to monitor the effectiveness of the seal provided after the shear ram 206 is actuated and the shear ram blades cut and seal the drill pipe 118, as shown in FIG. 3B.

Additionally, although the sensor units are shown in FIGS. 3A-3B as being located within the housing of one shear ram 128 of the primary BOP stack 116, it should be understood that sets of sensor units can similarly be provided within other preventers 128 that make up the primary BOP stack 116 shown in FIGS. 1-2. Moreover, although the sensor units are shown in FIGS. 3A-3B as being mounted directly within the housing of the shear ram 128, the sensor units can be located in a separate annular housings. The annular housings can be respectively mounted above and below the shear ram 128 so as to be in fluid communication with the drill pipe annulus of the shear ram 128 and enabling the sensors to capture the necessary measurements without modification of the shear ram 128 itself.

Figure 4:
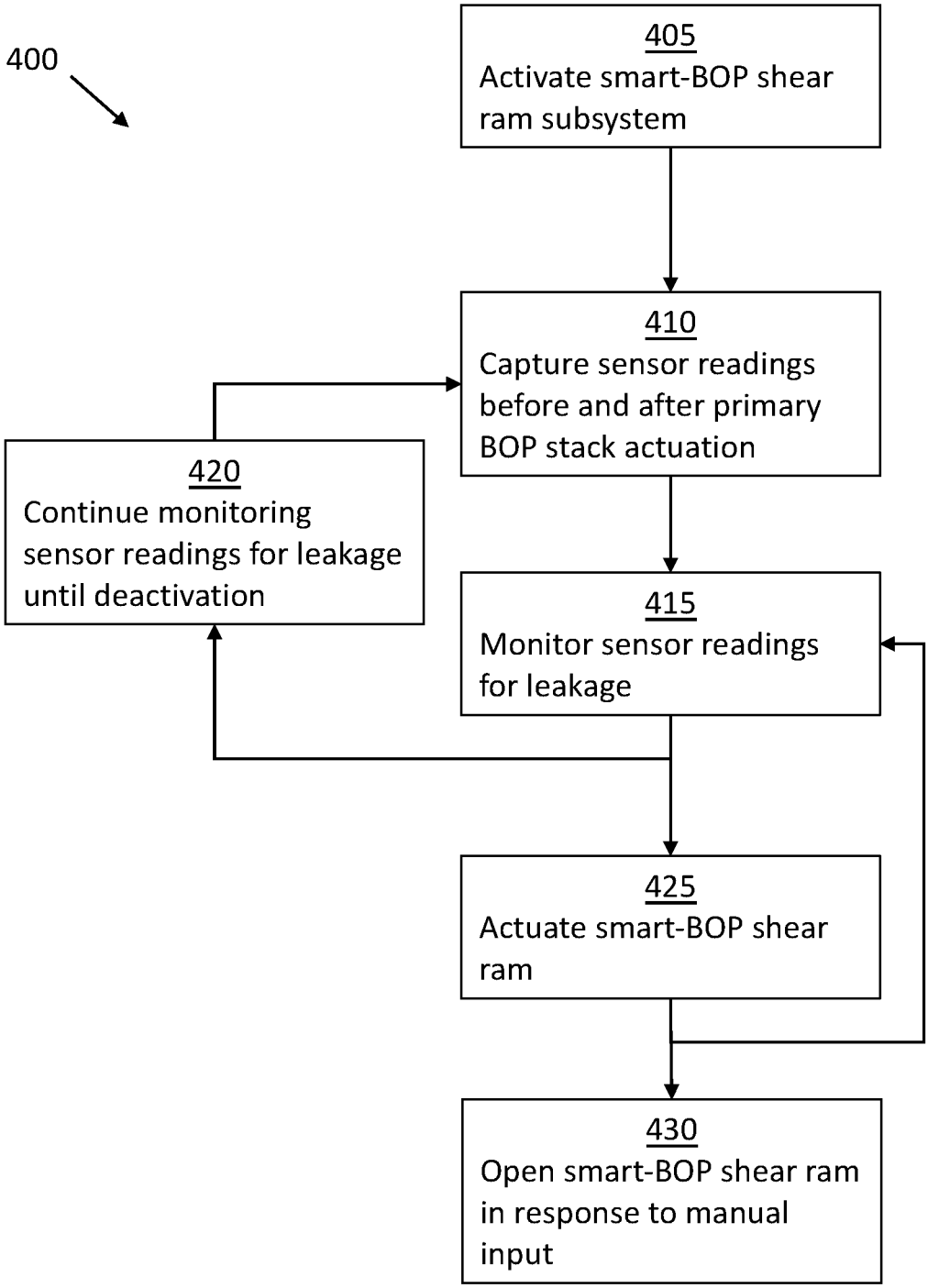
FIG. 4 is a process flow diagram illustrating a routine for shutting a well in using a smart-BOP shear ram according to an embodiment.

FIG. 4 is a process flow diagram illustrating an exemplary process 400 for operating the smart-BOP shear ram system 200 according to an embodiment. The process 400 can be performed by the LCU 222, which is configured by executing a Ram Controller Algorithm, to perform the various steps of routine 400 and the other operations described herein.

At step 405 the LCU 222 automatically activates the smart-BOP shear ram system 200 in response to a signal from the control panel 120 indicating that the primary BOP stack 116 has been actuated. In an embodiment, once the primary BOP stack 116 is activated by the driller from the BOP control panel 120, the LCU 222 assumes autonomous control over operation of the smart-BOP shear ram system 200 until the LCU confirms that a complete seal has been made against wellbore fluids.

Upon activation of the of the smart-BOP shear ram system 200, at step 410, the sensors (e.g., sensors 312, 314, 316, 318 and/or 340) are configured to respectively capture measurements from before, during and after the closure of the conventional shear rams. The measurements can be captured substantially continuously, or intermittently at a sampling frequency that is suitable for detecting the influx of wellbore fluids.

At step 415, the LCU 222 compares the sensor readings captured from before and after the closure of the conventional shear rams in order to determine whether the preventers 128 of the BOP stack 116 have closed and whether they were able to successfully contain the influx of wellbore fluids or not.

In an embodiment, the temperature and pressure sensors data is preferably analyzed along with the flow meter and LEL sensor data, as pressure and temperature data alone can be insufficient for the Ram Controller Algorithm to reliably decide an action. More specifically, the LCU 222 can be configured to first analyze the readings of fluid flow sensors provided above and below the conventional shear rams. If the conventional shear ram is closed effectively, the fluid flow sensors above the conventional shear ram will not detect fluid movement in the annulus and inside the drill pipe. There will also be a sudden change in the pressure and temperature sensor readings taken above and below the conventional shear rams. In the rare case that the conventional shear rams completely seal around the pipe but do not manage to cut the pipe, then the sealing of the pipe is practically ineffective as the pipe is mostly bent. In such an instance, the fluid flow within the pipe continues to be detectable using the flow sensors whereas the temperature and pressure sensors might show a properly sealed drill pipe anulus. Accordingly, the Ram Controller Algorithm can configure the LCU 222 to supersede the pressure and temperature readings and determine, based on the flow meter and LEL sensors data, that the seal is ineffective and actuate the smart-BOP shear rams. In-cases where LEL sensors are also unable to provide conclusive data (e.g. hydrocarbons have not yet reached the surface), the Ram Controller Algorithm can configure the LCU 222 such that the fluid flow sensor will supersede all other sensors data in the determination of whether a seal has been achieved and whether to actuate the smart-BOP shear rams. In an embodiment, the Ram Controller Algorithm can be programmed to close the smart-BOP shear rams even if there is a minor chance of fluid flow after the closure of the conventional shear rams, the reason being that the closure of the smart-BOP shear rams above the conventional shear rams does present a significant negative risk. By comparison, even a minor leak across the conventional shear rams can create a disaster. Accordingly, the Ram Controller Algorithm can be purposefully designed to avoid that by closing the smart-BOP shear rams in such scenarios.

In an embodiment, the Ram Controller Algorithm comprises artificially intelligent (AI) software trained to analyze sensor readings to detect leakage and determine whether to close the smart-BOP shear rams in-case of primary shear ram failure. As noted above, the Ram Controller Algorithm is executed as soon as the conventional shear ram closes. The Ram Controller Algorithm configures the LCU 222 to compare the readings before and after the conventional shear ram closure as the sensor data is continuously recorded throughout operation. The AI-based Ram Controller Algorithm can be trained to analyze and correlate the sensor readings to detect various operating conditions and determine whether those operating conditions require closure of the smart-BOP shear rams. Training of the AI Ram Controller Algorithm can include applying Machine Learning techniques to sensor data captured during operation of a conventional BOP shear ram under various testing scenarios and from sensor data collected during live-operation of the smart-BOP shear ram system in the field.

In the event that the LCU 222 detects that the preventers 128 of the BOP stack 116 were able to successfully contain the influx of wellbore fluids, at step 420, the LCU continues to monitor the sensor readings (e.g., by repeating steps 410-415) until the smart-BOP shear ram system 200 is manually deactivated by the system operator. In addition or alternatively, the LCU 222 can be configured to automatically deactivate the system 200 after a prescribed period of time without any detectible leaks or kicks has elapsed.

In the event that the LCU 222 detects that the preventers 128 of the BOP stack 116 were unable to successfully contain the influx of wellbore fluids, at step 425, the LCU 222, actuates the PPU 218, which in turn actuates the shear ram 206 causing it to close and, preferably, seal the wellbore. Additionally, in connection with step 425, the LCU 222 using one or more of the sensors of the smart-BOP shear ram system (e.g., sensors 312, 314, 316, 318 and/or 340), can continue to monitor the sensor readings, for instance by repeating step 415, to detect whether a complete seal has been made against the wellbore fluids by the shear ram 206.

In an embodiment, the LCU 222 is configured to actuate the shear ram 206 autonomously, but only causes the shear ram 206 to open in response to receipt of an open command from the drillers control panel 120, at step 430. Accordingly, in some embodiments, the smart-BOP shear ram system 200 can further comprise a remotely located user interface (not shown) that is configured to allow the driller to monitor the operation of the smart-BOP shear ram system 200 and provide inputs to the LCU 222. For instance, the remote user interface can be provided at the control panel 120 and communicatively coupled with the LCU 222 over a wired or wireless communication connection 228. In some implementations, the remote control user interface can include a user input device, such as a button, configured to allow the driller to manually activate the shear ram 206 thereby bypassing the autonomous functionality of the Ram Controller Algorithm when required, say, in-case the LCU 222 fails to detect a minor leak. In such a configuration, the remote interface can be configured to activate the PPU 218 directly, or indirectly via the LCU 222.

In some embodiments, the remote interface can include a user input device, such as a button, that when actuated, sends an "open" command to the LCU 222 causing the shear ram 206 to transition from the closed state, as shown in FIG. 3B, back to an open state, as shown in FIG. 3A.

In some embodiments, the remote interface can also comprise a display unit configured to output information received from the LCU 222 relating to the operation of the smart-BOP shear ram system 200, including, for example, a status of the shear ram 206, whether any leaks have been detected, measurements captured using the various sensors and information derived therefrom.

Figure 5:
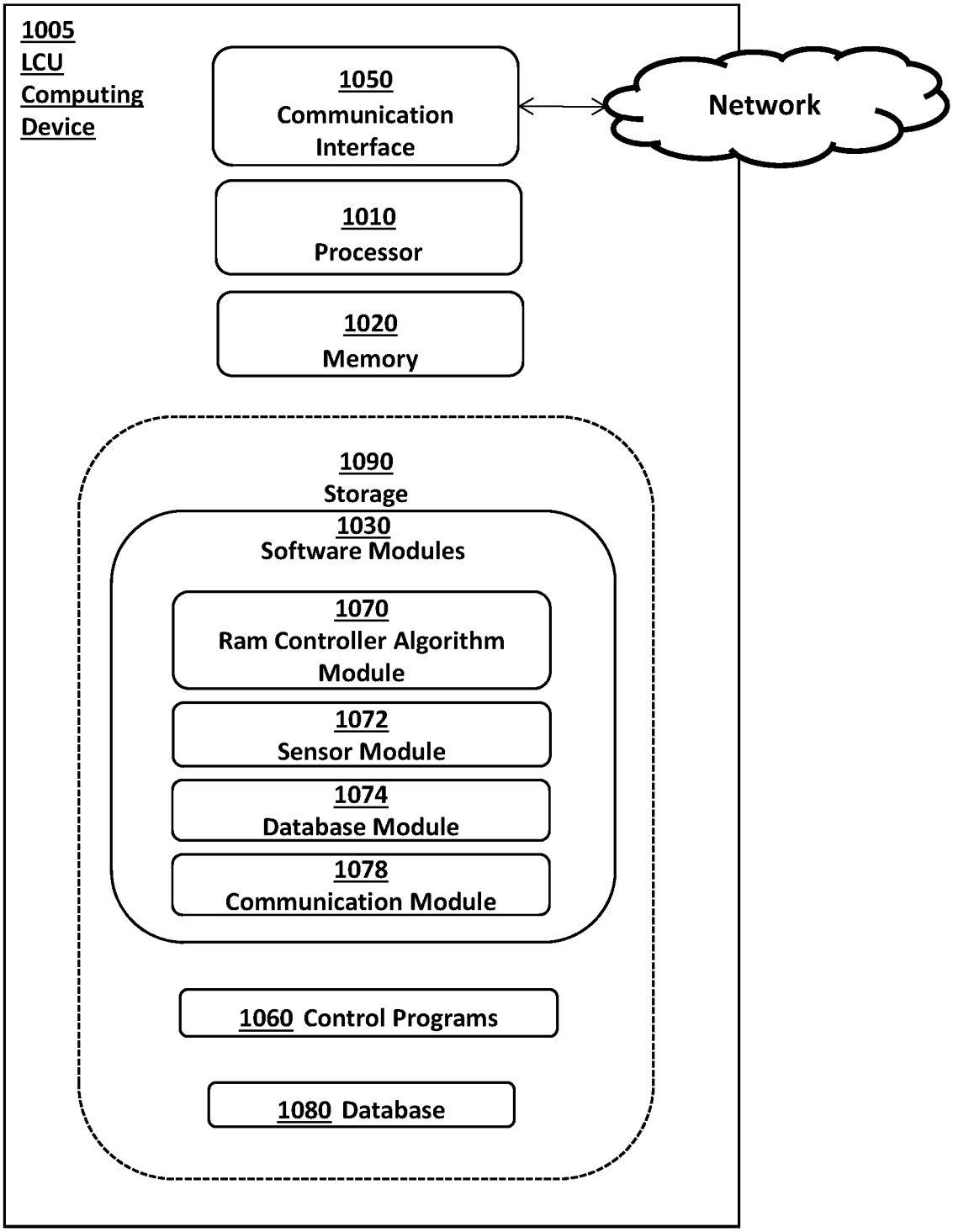
FIG. 5 is a block diagram of a controller computing device such as the local control unit of the smart-BOP shear ram, according to an embodiment.

An exemplary configuration of a controller computing device such as a computing device of the LCU 222 is shown and described in connection with FIG. 5. The methods discussed above can be accomplished in whole or in part using the controller computing device 1005, as described in further detail below.

In a non-limiting example, the controller computing device 1005 can be arranged with various hardware and software components that serve to enable operation of the system 200, including a processor 1010, a memory 1020, a communication interface 1050 and a computer readable storage medium 1090. The processor 1010 serves to execute software instructions that can be loaded into the memory 1020. The processor 1010 can be a number of processors, a multi-processor core, or some other type of processor, depending on the particular implementation.

Preferably, the memory 1020 and/or the storage 1090 are accessible by the processor 1010, thereby enabling the processor 1010 to receive and execute instructions stored on the memory 1020 and/or on the storage 1090. The memory 1020 can be, for example, a random access memory (RAM) or any other suitable volatile or non-volatile non-transitory computer readable storage medium. In addition, the memory 1020 can be fixed or removable.

The storage 1090 can take various forms, depending on the particular implementation. For example, the storage 1090 can contain one or more components or devices such as a hard drive, a flash memory, a rewritable optical disk, a rewritable magnetic tape, or some combination of the above. The storage 1090 also can be fixed or removable or remote such as cloud based data storage systems.

One or more software modules 1030 are encoded in the storage 1090 and/or in the memory 1020. The software modules 1030 can comprise one or more software programs or applications having computer program code or a set of instructions executed in the processor 1010. Such computer program code or instructions for carrying out operations and implementing aspects of the systems and methods disclosed herein can be written in any combination of one or more programming languages. The program code can execute entirely on controller computing device 1005, as a stand-alone software package, partly on the controller computing device 1005 and partly on a remote computer/device or entirely on such remote computers/devices. In the latter scenario, the remote computer systems can be connected to controller computing device 1005 through any type of network, including a local area network (LAN) or a wide area network (WAN), or the connection can be made through an external computer (for example, through the Internet using an Internet Service Provider).

Preferably, included among the software modules 1030 are a communication module 1078, database module 1074, the Ram Controller Algorithm module 1070 and a sensor module 1072. Communication module 1078 configures the processor to communication with various components of the smart-BOP shear ram system 200 and the well system 100 more generally. Database module 1074 configures the processor to perform various data storage operations, such as sensor data storage. Sensor module 1072 configures the processor to operate the various sensor units of the system 200. The Ram Controller Algorithm module 1070 configures the processor to implement the various features and functions of the smart-BOP shear ram system 200 including, for example and without limitation, analyzing the sensor data, determining whether leaks are present, actuating the shear ram 206 and related devices and other such operations. In addition, it should be noted that other information and/or data relevant to the operation of the present systems and methods can also be stored on the storage 1090, for instance various control programs 1060 used in the operation of the controller computing device 1005.

A database 1080 can also be stored on the storage 1090. Database 1080 can contain and/or maintain various data items and elements that are utilized throughout the various operations of the system including, for example, sensor data, configuration data and the like. It should be noted that although database 1080 is depicted as being configured locally to the storage of the controller computing device 1005, in certain implementations, database 1080 and/or various of the data elements stored therein can be located remotely (such as on a remote server—not shown) and connected to the controller computing device 1005 through a network in a manner known to those of ordinary skill in the art.

A communication interface 1050 is also operatively connected to the processor 1010 and can be any interface that enables communication between the controller computing device 1005 and external devices, machines and/or elements. Preferably, the communication interface 1050 includes, but is not limited to, a modem, a Network Interface Card (NIC), an integrated network interface, a radio frequency transmitter/receiver (e.g., Bluetooth, cellular, NFC), a satellite communication transmitter/receiver, an infrared port, a USB connection, and/or any other such interfaces for connecting controller computing device 1005 to other computing devices and/or communication networks, such as private networks and the Internet. Such connections can include a wired connection or a wireless connection (e.g., using the IEEE 802.11 standard) though it should be understood that communication interface 1050 can be practically any interface that enables communication to/from the controller computing device 1005.

At this juncture, it should be noted that although much of the foregoing description has been directed to systems and methods for implementing a well shut-in system comprising a smart-BOP shear ram system, the systems and methods disclosed herein can be similarly deployed and/or implemented in scenarios, situations, and settings far beyond the referenced scenarios. It is to be understood that like numerals in the drawings represent like elements through the several figures, and that not all components and/or steps described and illustrated with reference to the figures are required for all embodiments or arrangements.

Thus, illustrative embodiments and arrangements of the present systems and methods provide a system, processes and computer implemented control methods, computer system, and computer program product. The flowchart and block diagrams in the figures illustrate the architecture, functionality, and operation of possible implementations of systems, methods and computer program products according to various embodiments and arrangements. In this regard, each block in a flowchart or block diagrams as it relates to a computer implemented method can represent a module, segment, or portion of code, which comprises one or more executable instructions for implementing the specified logical function(s).

It should also be noted that, in some alternative implementations, the functions described herein or noted in a block diagram can occur out of the order noted. For example, two blocks or operations shown or described in succession may, in fact, be executed substantially concurrently, or can sometimes be executed in the reverse order, depending upon the functionality involved. It will also be noted that functional blocks or operations can, where applicable, be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A well shut-in system comprising:

a smart blow-out preventer (BOP) system for use with a primary BOP system and for automatically and autonomously shutting in a wellbore in the event of failure of the primary BOP system, the primary BOP system including one or more preventers configured to be manually activated from a remotely located control panel to shut-in the wellbore, the smart-BOP system comprising:

a shear ram configured to be mounted on top of the one or more preventers of the primary BOP system and configured to shut-in the wellbore, the shear ram including:

an outer housing defining a central cavity for receiving a wellbore tubular pipe therethrough, and two opposing cutting blades, wherein the cutting blades of the shear ram are pneumatically transitioned from an open state to a closed state for cutting the pipe;

a plurality of sensor units provided above and below the one or more preventers of the primary BOP system and within a pipe annulus of the one or more preventers, the plurality of sensor units being configured to wirelessly transmit respective measurements to a local control unit and including:

a plurality of fluid movement sensors, a plurality of pressure sensors, and a plurality of temperature sensors;

a shear ram control system configured to operate separately and independently from the primary BOP system, the shear ram control system including:

a pneumatic power unit in fluid communication with the shear ram and configured to actuate the shear ram by providing pneumatic fluid to the shear ram through pneumatic control lines, the pneumatic power unit being in fluid communication with a compressor unit and being communicatively coupled to the local control unit through a hard-wired connection, and wherein the pneumatic power unit is configured to contain a compressed air charge sufficient to close the cutting blades of the shear ram, the compressor unit, wherein the compressor unit is configured to supply the pneumatic power unit with compressed air, a backup battery, wherein the backup battery is configured to store enough electrical energy for operating the shear ram control system in the absence of an external power supply, and the local control unit, the local control unit including a processor and a non-transitory computer readable storage medium having a ram controller algorithm stored thereon, wherein the local control unit is in wireless communication with the plurality of sensors, wherein the ram controller algorithm is executable by the processor and configures the processor to, activate the plurality of sensor units in response to receipt of a signal from the control panel of the primary BOP system indicating that the primary BOP system has been triggered to close the one or more preventers to shut-in the wellbore, wherein the plurality of sensors are configured to capture the respective measurements from within the pipe annulus during a period of time before and after the closing of the one or more preventers, compare the respective measurements of the plurality of sensors captured before closing of the one or more preventers to the respective measurements captured after closing of the one or more preventers, detect, based on the comparison, a failure of the one or more preventers to shut-in the wellbore, and trigger, based on detecting the failure, the pneumatic power unit to actuate the shear ram thereby closing the cutting blades to shear the tubular pipe and shut-in the wellbore; and one or more explosion-proof housings, wherein the shear ram control system is housed within the one or more explosion-proof housings.

2. The system of claim 1, wherein the fluid movement sensors are circumferentially distributed within the pipe annulus relative to the tubular pipe.

3. The system of claim 2, wherein the fluid movement sensors are acoustic sensors configured to record sound log data, and wherein the local control unit is configured to analyze the sound log data captured before and after the closing of the one or more preventers to determine whether any change in the sound log data indicates an influx of fluid from the wellbore into one or more of the tubular pipe and the pipe annulus, and wherein the local control unit is configured to analyze the temperature and pressure sensor measurements captured before and after the closing of the one or more preventers to determine whether any change in temperature and pressure indicates an influx of fluid from the wellbore into one or more of the tubular pipe and the pipe annulus.

4. The system of claim 1, further comprising: one or more lower explosive limit (LEL) sensors configured to detect hazardous levels of a combustible vapor in air, wherein the local control unit is further configured to detect the failure of the one or more preventers based on LEL sensor measurements captured after the closing of the one or more preventers.

5. The system of claim 1, wherein the plurality of sensor units comprise six sensor units, wherein three sensor units are mounted within the pipe annulus above cutting blades of the one or more preventers and spaced 120 degrees apart circumferentially, and wherein three of the sensor units are mounted within the pipe annulus below the cutting blades of the one or more preventers and aligned with the three sensor units mounted above the cutting blades of the one or more preventers.

6. The system of claim 1, wherein the local control unit is configured to, in response to receipt of the signal from the control panel of the primary BOP system indicating that the primary BOP system has been triggered, autonomously control operation of the smart-BOP shear ram system until the local control unit detects, using the plurality of sensor units, that a complete seal has been made against wellbore fluids by the one or more preventers or the shear ram.

7. The system of claim 1, further comprising:

a remote control user interface communicatively coupled with the local control unit, wherein, after actuation of the shear ram, the local control unit is configured to only open the shear ram in response to a manually input command received from the remote control user interface.

8. The system of claim 1, wherein, after actuation of the shear ram, the local control unit is configured to monitor the respective measurements captured using the plurality of sensor units to determine whether actuation of the shear ram has effectively shut-in the wellbore.

9. The system of claim 1, further comprising: the primary BOP system, the primary BOP system including:

the one or more preventers, a hydraulic power unit in fluid communication with the one or more preventers and configured to actuate the one or more preventers by providing a controlled pressure hydraulic fluid to the one or more preventers through hydraulic control lines, the hydraulic power unit being operatively connected to the control panel, and the control panel operatively connected to the hydraulic power unit and configured to actuate the hydraulic power unit and thereby actuate the one or more preventers to shut-in the wellbore.

10. A well shut-in method, comprising:

providing, a smart blow-out preventer (BOP) system on top of a primary BOP system of a wellbore, the primary BOP system including one or more preventers configured to be manually activated from a remotely located control panel to shut-in the wellbore, wherein the smart-BOP system is configured for automatically and autonomously shutting in the wellbore in the event of failure of the primary BOP system, and wherein the smart-BOP system comprises:

a shear ram configured to be mounted on top of the one or more preventers of the primary BOP system and configured to shut-in the wellbore, the shear ram including:

an outer housing defining a central cavity for receiving a wellbore tubular pipe therethrough, and two opposing cutting blades, wherein the cutting blades of the shear ram are pneumatically transitioned from an open state to a closed state for cutting the pipe;

a plurality of sensor units provided above and below the one or more preventers of the primary BOP system and within a pipe annulus of the one or more preventers, the plurality of sensor units being configured to wirelessly transmit respective measurements to a local control unit and including:

a plurality of fluid movement sensors, a plurality of pressure sensors, and a plurality of temperature sensors;

one or more explosion-proof housings, a shear ram control system contained within the one or more explosion-proof housings, the shear ram control system being configured to operate separately and independently from the primary BOP system, and the shear ram control system including:

a pneumatic power unit in fluid communication with the shear ram and configured to actuate the shear ram by providing pneumatic fluid to the shear ram through pneumatic control lines, the pneumatic power unit being in fluid communication with a compressor unit and being communicatively coupled to the local control unit through a hard-wired connection, and wherein the pneumatic power unit is configured to contain a compressed air charge sufficient to close the cutting blades of the shear ram, the compressor unit, wherein the compressor unit is configured to supply the pneumatic power unit with compressed air, a backup battery, wherein the backup battery is configured to store enough electrical energy for operating the shear ram control system in the absence of an external power supply, and the local control unit, the local control unit including a processor and a non-transitory computer readable storage medium having a ram controller algorithm stored thereon, wherein the local control unit is in wireless communication with the plurality of sensors, and wherein the processor is configured by executing the ram controller algorithm;

receiving, by the local control unit, a signal from the control panel of the primary BOP system indicating that the primary BOP system has been triggered to close the one or more preventers to shut-in the wellbore;

activating, by the local control unit in response to receipt of the signal from the control panel, the plurality of sensor units;

capturing, by the plurality of sensor units, the respective measurements from within the pipe annulus during a period of time before and after the closing of the one or more preventers;

comparing, by the local control unit, the respective measurements of the plurality of sensors before closing of the one or more preventers to the respective measurements captured after closing of the one or more preventers, detecting, by the local control unit based on the comparison, a failure of the one or more preventers to shut-in the wellbore; and triggering, by the local control unit based on detecting the failure, the pneumatic power unit to actuate the shear ram and thereby closing the cutting blades to shear the tubular pipe and shut-in the wellbore.

11. The method of claim 10, wherein the fluid movement sensors are acoustic sensors configured to record sound log data, and wherein the detecting step comprises:

analyzing the sound log data captured before and after the closing of the one or more preventers to determine whether any change in the sound log data indicates an influx of fluid from the wellbore into one or more of the tubular pipe and the pipe annulus, and analyzing the temperature and pressure sensor measurements captured before and after the closing of the one or more preventers to determine whether any change in temperature and pressure indicates an influx of fluid from the wellbore into one or more of the tubular pipe and the pipe annulus.

12. The method of claim 10, wherein the smart-BOP system further comprises one or more LEL sensors configured to detect hazardous levels of a combustible vapor in air, and wherein the detecting step further comprises: monitoring LEL sensor measurements captured after the closing of the one or more preventers to detect increases in the LEL sensor measurements.

13. The method of claim 10, wherein the activating, capturing, comparing, detecting and triggering step are performed autonomously by the local control unit until the local control unit detects, using the plurality of sensor units, that a complete seal has been made against wellbore fluids by the one or more preventers or the shear ram.

14. The method of claim 13, wherein the smart-BOP system further comprises a remote control user interface communicatively coupled with the local control unit, and further comprising:

opening, by the local control unit, the shear ram in response to a manually input open command received from the remote control user interface.

15. The method of claim 13, further comprising:

after actuation of the shear ram, monitoring by the local control unit using the plurality of sensor units, the respective measurements captured using the plurality of sensor units to determine whether actuation of the shear ram has effectively shut-in the wellbore.

16. The method of claim 10, further comprising:

providing the primary BOP system, the primary BOP system including:

the one or more preventers, a hydraulic power unit in fluid communication with the one or more preventers and configured to actuate the one or more preventers by providing a controlled pressure hydraulic fluid to the one or more preventers through hydraulic control lines, the hydraulic power unit being operatively connected to the control panel, and the control panel operatively connected to the hydraulic power unit and configured to actuate the hydraulic power unit and thereby actuate the one or more preventers to shut-in the wellbore.

* * * * *